United States Patent [19]

Appelbaum

[11] 4,336,933

[45] Jun. 29, 1982

[54] REBOUND EXERCISE DEVICE FOR IN-PLACE JOGGING

[76] Inventor: Paul Appelbaum, P.O. Box 1477, Denver, Colo. 80150

[21] Appl. No.: 248,830

[22] Filed: Mar. 30, 1981

[51] Int. Cl.[3] ..... A63B 23/04; A63B 5/18

[52] U.S. Cl. ..... 272/70; 272/65

[58] Field of Search ..... 272/70, 65, 66, 93, 272/109, 117, 134, 144, 116, 135, 136, 137, 138, 139; 5/2 R, 2 B; 194/1 A, 1 B; 182/35, 139, 140

[56] References Cited

U.S. PATENT DOCUMENTS

| | | | |
|---|---|---|---|
| 249,431 | 11/1881 | Wheeler | 5/2 R X |
| 332,989 | 12/1885 | Benedict | 272/134 X |
| 2,324,970 | 7/1943 | Woolley | 272/65 |
| 3,741,538 | 6/1973 | Lewis et al. | 272/134 |
| 3,834,702 | 9/1974 | Bliss | 272/70 X |
| 3,874,657 | 4/1975 | Niebojewski | 272/144 X |
| 4,106,609 | 8/1978 | Kaspar | 194/1 B |
| 4,223,887 | 9/1980 | Holtz | 272/70 |
| 4,225,131 | 9/1980 | Sidlinger et al. | 272/70 X |
| 4,285,041 | 8/1981 | Smith | 272/70X |

FOREIGN PATENT DOCUMENTS

| | | | |
|---|---|---|---|
| 1321021 | 6/1973 | United Kingdom | 272/65 |

*Primary Examiner*—Richard J. Apley
*Assistant Examiner*—Arnold W. Kramer

[57] ABSTRACT

An exercise apparatus for in-place jogging including a support structure mounting a taut tramping mat, and including a wall-mounted housing, the support structure being rotatably mounted to the housing such that it is rotatable from an in-use position on the floor through about ninety degrees to be engaged and held by the housing in a storage position.

13 Claims, 2 Drawing Figures

REBOUND EXERCISE DEVICE FOR IN-PLACE JOGGING

BACKGROUND OF THE INVENTION

Along with the recent rise in popularity of jogging there has emerged some of the less desirable aspects of the sport such as the limitations caused by inclement weather and extremes in air temperatures, and the injuries to the lower extremities associated with jogging on hard and semi-hard surfaces.

As a result there has been increasing use of the in-place jogging apparatus which resembles a small trampoline suitable for use by one person.

However, the exercise and health benefits that can be derived from use of such in-place jogging devices have not been made readily available to the traveling person who must stay at hotels and motels. This is because of the floor space requirements called for by conventional in-place jogging devices.

Thus it is an object of the present invention to provide a wall-mounted in-place jogging device that can be locked into a storage position which is off the floor and adjacent the wall, and that can be unlocked and rotated to an in-use position on the adjacent floor while remaining securely attached to the wall-mount.

It is another object of the invention to provide a wall-mounted in-place jogging device the use of which is controlled by a coin operated lock mechanism.

It is still another object of the invention to provide a jogging device that incorporates instrumentation for measurement of performance and bodily response of the exercising person.

BRIEF SUMMARY OF THE INVENTION

Accordingly, the present invention provides an exercise apparatus for in-place jogging having a wall-mounted configuration and an in-use configuration on floor space adjacent the wall, including a hollow metallic support frame mounting a mat of flexible sheet material by biasing means in a central opening in the top wall of the support frame. The support frame is rotatably mounted to a wall-mounted housing by means of a connecting member which is hinged at its attach point with the lower extremity of the housing and at its attach point at a bottom edge of the support frame, such that the frame can be rotated off the floor through about ninety degrees and into a recessed portion of the upper part of the housing and into locking engagement therewith. There is a hand grasp bar extending substantially in a horizontal direction attached to the housing top. In a preferred embodiment there is a coin operated release mechanism and means for sensing and displaying in readout form the number of oscillations made by the mat. In a preferred embodiment the support frame has at least four side walls each of which is smaller on its lower edge than on its upper edge.

DETAILED DESCRIPTION OF THE DRAWINGS

Figure 1:
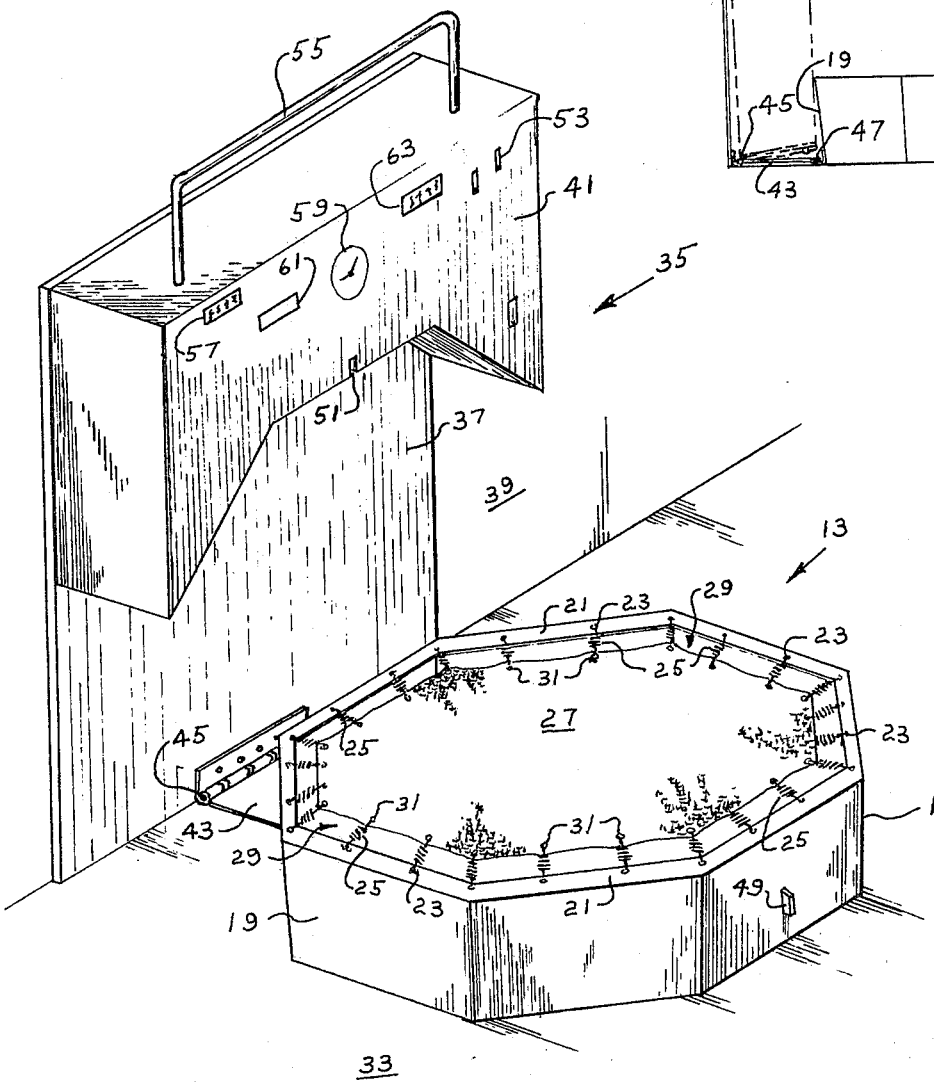
FIG. 1 is a perspective view of the apparatus in the in-use position.

As FIG. 1 shows the in-place jogging exerciser includes a jogging platform 13 that comprises a support structure 17, which in the preferred embodiment is fabricated of 13 gage cold rolled sheet metal to form a generally hollow box having an octagonal configuration when viewed from above. Each side panel of support 17 has a bottom edge that is shorter than its top edge, such that the bottom of the support structure 17 covers a smaller area, horizontally, than does the uppermost portion of structure 17. A skirt portion 21 extends inwardly from the uppermost edge of support 17. Spring attach points 23, which maybe slots or holes or other suitable attach points for a conventional coil spring are spaced along the inner periphery of skirt portion 21, are engaged by first ends of coil springs 25.

A mat 27 of a durable, flexible sheet material which is preferrably fiberglass or nylon reinforced, is suspended in a taut condition in the top opening 29 of support 17 by the springs 25, which have second ends which are affixed to attach points 31 located around the periphery of mat 27. An annular skirt of sheet material, not shown, may be used as a protective and safety device to cover the springs 25 and the gap between mat 27 and skirt 17.

A substantial portion of the bottom wall of support 17 engages floor 33 when platform 13 is in its on-floor position as shown in FIG. 1.

As FIG. 1 shows there is a platform housing 35 which comprises a metallic wall plate 37 which lies flush against wall 39, and which is securely anchored to the wall substrate structure by suitable fastening means.

Figure 2:
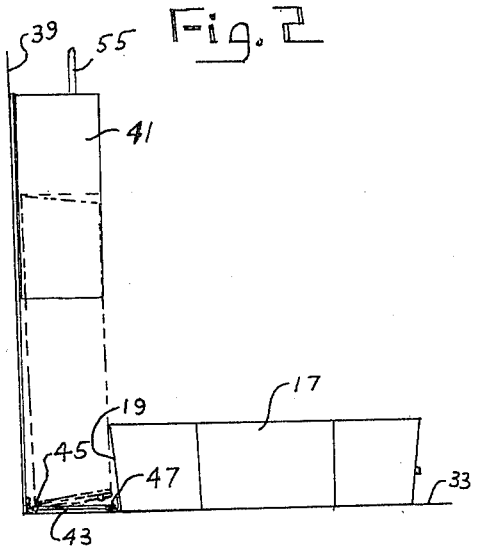
FIG. 2 is a side view of the apparatus shown in FIG. 1.

Affixed to wall plate 37 is box-like metallic upper housing 41, having a generally concave lower portion which receives the upper end of platform 13 when platform 13 is in its storage position as illustrated by phantom lines in FIG. 2.

The platform 13 is mounted to wall housing 35 by means of metallic connector 43 which is secured to plate 37 by a first hinge joint 45 to a lower edge of a support frame panel 19 by a second hinge joint 47, shown in FIG. 2. These hinge connections will permit the platform 13 to be rotated from its on-floor position shown in FIG. 1, to its storage position in which latch component 49, located on a side panel 19 will engage locking means, not shown, located in the upper housing 41 via opening 51 so as to be locked in storage configuration.

In the preferred embodiment the locking means is a coin-operated mechanism of conventional design in which insertion of the proper amount of coins via coin receiver 53 will unlock platform 13 from storage position, so as to enable its rotation to position on floor 33.

In another embodiment, not shown, the locking mechanism is not coin-operated but rather utilizes a hand operated release located on upper housing 41.

A hand grasp 55 is firmly attached to the top wall of upper housing 41. In the preferred embodiment, hand grasp 55 incorporates an integral hand activated sensor of a heart pulse measuring device, such as that manufactured by Owl Instruments, Ltd. of Ontario, Canada and sold under the tradename EXERPACER, and which includes a digital readout display at 57.

Other instrumentation on the preferred embodiment includes a Timer 59, and a tramp meter 61 which electrically connects with a sensor located in support 17, and which presents a digital display reflecting the number of oscillations of the mat 27. Connected to tramp meter 61 is mileage indicator 63 which reads out the equivalent in fractions of miles of the number of oscillations of mat 27.

Note that, as FIG. 1 illustrates, during rotation of platform 13 off floor 33, the upper surface of connector 43 will engage the surface of a panel 19, before platform 13 is completely in storage position. This feature permits a slope-walled platform such as platform 13 to be firmly secured as shown and yet be capable of complete rotation to a storage position as illustrated.

In the operation of the apparatus shown in FIG. 1, platform 13, which when not in-use is off the floor 33 and locked in its storage position, is released by insertion of the proper coinage or other suitable release means, at 53, and then brought by the operator to the in-use position on floor 33, as shown in FIG. 1. The exercising person may use hand grasp 55 to steady himself. When jogging is completed, the exercising person will take note of his performance by refering to the above-described instrumentation. Platform 13 may then be manipulated off the floor and locked into storage position.

It is apparent that, within the scope of the invention, modifications and different arrangements may be made other than herein disclosed and the present disclosure is merely illustrative, the invention comprehending all variations thereof.

What is claimed is:

1. Exercise apparatus for in-place jogging having a wall-mounted storage configuration and an in-use configuration on floor space adjacent the wall, comprising:

(a) a hollow, box-like metallic support frame, having a bottom wall that engages the floor when said apparatus is in its in-use configuration, and having a top wall with a central opening therein;

(b) a mat of flexible sheet material mounted in the central opening of said top wall to the periphery of said mat;

(c) a wall-mounted housing fixedly attached to the wall and having a lower portion which extends to the juncture of floor and wall, said housing being connected to said support frame by a connecting member which has a first end which is hinge-connected, about a horizontally extending axis, to the lower extremity of the lower portion of said housing and a second end which is hinge-connected, about a horizontally extending axis, to a lower portion of said support frame, said housing being adapted to receive and hold said support frame when said frame is rotated through about ninety degrees off the floor and to a storage configuration adjacent the wall.

2. Apparatus as defined in claim 1 wherein the lower part of the upper portion of said housing is recessed so as to receive passage of a portion of said support frame when in its storage configuration.

3. Apparatus as defined in claim 2 wherein said housing upper portion has latching means for engaging said frame and holding it in its storage configuration.

4. Apparatus as defined in claim 3 wherein said latching means is coin-operated.

5. Apparatus as defined in claim 4 wherein a hand grasp is affixed to the upper portion of said housing.

6. Apparatus as defined in claim 5 wherein said hand grasp is attached to the top surface of said upper housing portion and has a substantially longitudinally extending portion.

7. Apparatus as defined in claim 6 including a heart pulse rate measurement apparatus having a digital readout display attached to said housing and wherein said hand grasp is connected to said apparatus and is adapted to sense the pulse rate of a person when grasped by a person.

8. Apparatus as defined in claim 3 wherein said support frame has at least four side walls, each of which slopes at an angle to the vertical plane, the bottom edge of each of said side walls being shorter than the top edge of each of said side walls.

9. Apparatus as defined in claim 8 wherein said support frame has eight side walls.

10. Apparatus as defined in claim 8 wherein a major surface of said connecting member lies in a generally horizontal plane, adjacent the floor, when said support frame is in its in-use configuration, and lies flush adjacent a side wall of said support frame in its storage configuration.

11. Apparatus as defined in claim 3 including an elapsed time display mechanism attached to said housing.

12. Apparatus as defined in claim 3 including a sensor attached to said support and which is responsive to the number of oscillations of said mat.

13. Apparatus as defined in claim 12 including means connected to said sensor for providing a visual readout and display of the number of oscillations of said mat.

* * * * *